United States Patent [19]

Leuchtenmüller et al.

[11] Patent Number: 5,035,033

[45] Date of Patent: Jul. 30, 1991

[54] NEEDLE BOARD FOR AN APPARATUS FOR NEEDLING A NON-WOVEN FABRIC

[75] Inventors: Rudolf Leuchtenmüller, Schwertberg; Manfred Kapeller, Traun; Johann Schöfberger, Linz, all of Austria

[73] Assignee: Textilmaschinenfabrik Dr. Ernst Fehrer Aktiengesellschaft, Leonding, Austria

[21] Appl. No.: 483,055

[22] Filed: Feb. 21, 1990

[30] Foreign Application Priority Data

Feb. 27, 1989 [AT] Austria ..... 427/89

[51] Int. Cl.[5] ..... D04H 18/00

[52] U.S. Cl. ..... 28/115

[58] Field of Search ..... 28/115

[56] References Cited

U.S. PATENT DOCUMENTS 3,397,436 8/1968 Zocher ..... 28/115

3,606,654 9/1971 Dilo ..... 28/115

FOREIGN PATENT DOCUMENTS 81040318 6/1981 Fed. Rep. of Germany .

*Primary Examiner*—Werner H. Schroeder

*Assistant Examiner*—John J. Calvert

*Attorney, Agent, or Firm*—Kurt Kelman

[57] ABSTRACT

A needle board for an apparatus for needling a non-woven fabric comprises a carrier plate, which is provided with an elastic layer for retaining needles, which are detachably inserted in through holes and have angled needle butts, which are supported on the surface of the board. In order to ensure an improved guidance and retention of the needles the elastic layer is provided on that surface of the board which is remote from the needle butts.

5 Claims, 1 Drawing Sheet

NEEDLE BOARD FOR AN APPARATUS FOR NEEDLING A NON-WOVEN FABRIC

BACKGROUND OF THE INVENTION

1. Field of the Invention

This invention relates to a needle board for an apparatus for needling a non-woven fabric, comprising a carrier plate provided with an elastic layer, which is parallel to said plate and serves to retain needles, which are detachably held in through holes of the carrier plate and have needle butts, which are angled from the needle shanks and supported on the surface of the needle board, wherein the needle shanks are guided in the through holes of the carrier plate.

2. Description of the Prior Art

The needles of a needle board used to needle a non-woven fabric are subjected to wear and are also subjected to loads which may result in a damage to the needles. For this reason the needles must detachably be mounted in the needle board. It is known to provide a needle board consisting of a carrier plate, which is provided with an elastic surface layer on that side of the needle board which is remote from the non-woven fabric that is to be needled. As a result, the individual needles which extend in through bores through the carrier plate and through the elastic surface layer will be held against falling out during a manipulation of the needle board performed for a replacement of the needles even when the needles are only loosely held in the through bores of the carrier plate. But because the elastic surface layer must support the angled needle butts and for that purpose must have a certain hardness, the desired retention of the needles in the elastic surface layer will no longer be ensured after a few replacing operations. In order to avoid said disadvantages it is known form German Utility Model 81 04 031 to permit the angled needle butts to snap into dovetail grooves of the elastic surface layer. But even if the needle butts are additionally retained in that manner the required minimum hardness of the surface layer will involve a risk that a repeated replacement of needles will expand the dovetail grooves beyond the elastic limit. Besides, even that design cannot suppress a wobbling motion of the needles in the through bores of the carrier plate if a certain play of the needles in the through bores has resulted after a repeated replacement of needles.

It is known that the radial play can be avoided in that sleeves of plastic or spring steel are inserted in the through bores of the carrier plate but this will involve a considerable expenditure, which is usually not accepted, particularly because the sleeves may not be inserted into the through bores with the required care so that the needles may assume an incorrect orientation so that the risk of damage to the needles will considerably be increased.

In another known needle board known from British Patent Specification No. 1,157,772 the needles are not guided in through holes of a carrier plate but are guided in two elastic surface layers, which cover said carrier plate on both sides, so that inaccuracies in the drilling of the through bores in the carrier plate will be avoided and the needles can more easily be replaced. As the needles extend through the through holes in the carrier plate with a considerable radial clearance so that they are not guided by the surfaces defining such holes, the elastic surface layers must be relatively hard so that said layers can guide the needles although said guiding functions will not perfectly be performed even if the surface layers are relatively hard. On the other hand, the use of the harder layers will involve the disadvantages explained hereinbefore.

SUMMARY OF THE INVENTION

For this reason it is an object of the invention to provide a needle board which is of the kind described first hereinbefore with simple means which will ensure an improved retention and guidance of the needles in the needle board.

The object set forth is accomplished in accordance with the invention in that the elastic layer surround the needle shanks at a distance from that surface of the plate on which the needle butts are supported.

Because the elastic layer is spaced from that surface of the plate on which the needle butts are supported and the carrier plate serves to support the angled needle butts, the elastic layer may have a lower hardness so that the retention of the needles in the elastic layer will directly be improved because the permanent expansion of the through holes in the elastic layer will be limited even in case of a repeated replacement of needles. It must also be borne in mind that a drilling of the through holes in the carrier plate and in the elastic layer by the same operation will result in an appreciable elastic displacement of material in said elastic layer so that the extraction of the drills will cause said elastically displaced material to reduce the diameter of the holes in the elastic layer relative to the diameter of the adjacent hole in the carrier plate and the needle which has been stuck into said through holes will be more firmly retained although the shank of said needle can sufficiently be supported by the surface defining said hole in the carrier plate. In addition, the retention of the needles in the elastic layer will have the result that the needles are additionally guided at the needle shanks at a distance from that surface of the plate on which the needle butts are supported. Because the needles are thus supported at two axially spaced apart points the alignment of the needles will be improved and a wobbling motion of the needles will be damped when the needles have become loose and clearances have been formed between the shanks of the needles and the through holes in the carrier plate.

That attention will obviously increase with the distance between the elastic layer and that surface of the plate on which the needle butts are supported. Particularly desirable conditions will be obtained if the elastic layer is provided on that surface of the carrier plate which is remote from the needle butts. The retention of the needles in the through holes of the needle boards can further be improved by the provision of an additional elastic interlayer between the elastic layer and that surface of the plate on which the needle butts are supported. That additional interlayer provides a further support for the needle shanks and, as a result, a more exact guidance of the needles and that additional support will also assist the axial retention of the needles against an unintended falling of the needles out of the needle board.

As has been indicated hereinbefore the hardness of the elastic layer and obviously also the hardness of any additional interlayer which may be provided may be selected regardless of the requirement that said layer or layers must have a minimum hardness to support the needle butts but may mainly be selected with a view to the requirements regarding the elastic retention of the shanks whereas the needle butts are supported by the surface of the carrier plate, which by the surfaces defining the through holes serves also for the essential lateral guidance of the needles. Whereas the hardness of said layers may be determined in dependence on the requirements in each case, the usual requirements will generally be met if the elastic layer and any elastic interlayer have a Shore hardness below 80.

DETAILED DESCRIPTION OF THE PREFERRED EMBODIMENT

Figure 1:
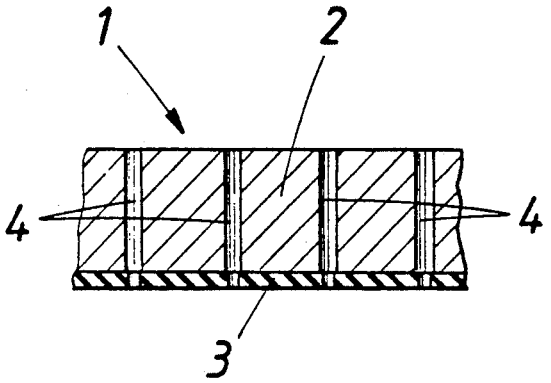
FIG. 1 is a fragmentary transverse sectional view showing a needle board in accordance with the invention for an apparatus for needling a non-woven fabric.

Illustrative embodiments of the invention will now be described in more detail with reference to the drawing.

Figure 2:
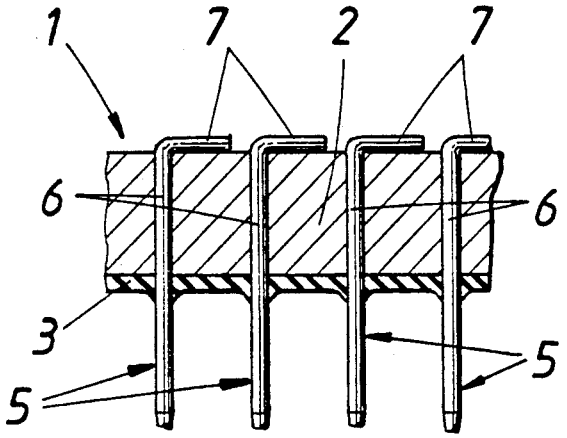
FIG. 2 shows the needle board according to FIG. 1 with inserted needles.

In the embodiment shown by way of example in FIGS. 1 and 2 a needle board 1 which is adapted to be mounted in an apparatus for needling a non-woven fabric comprises a carrier plate 2 and an elastic layer 3, which is provided on the carrier plate 2. The carrier plate 2 and the elastic layer 3 have through holes 4, which have been drilled by a common operation and contain needles 5, which have needle butts 7, which are angled from the needle shanks 6. A difference from conventional needle boards resides in that the elastic layer 3 is not provided on that surface of the needle board 1 on which the needle butts 7 are supported but is spaced from that surface and is preferably provided on that surface which faces the points of the needles. For this reason it is possible to select the hardness of the elastic layer 3 only in view of the requirements for the retention of the needles because the needle butts 7 can be supported on the non-yieldable surface of the carrier plate 2 and the required lateral support for the needle shanks 6 is provided in the through holes of the carrier plate 2. As a result, the elastic layer 3 may have a Shore hardness below 80. Owing to that relatively low hardness the drilling of the through holes 4 will have the result that part of the material of the elastic layer 3 is elastically displaced outwardly away from the drill so that the holes are smaller in diameter in said layer 3 than in the carrier plate 2, as is indicated in FIG. 1. For this reason the shanks 6 of the needles 5 which have been stuck into the through holes 4 will elastically be retained in the elastic layer 3 even after a repeated replacement of the needles. Because the needles are retained not only at the needle butts 7 but also in the elastic layer 3, the guidance of the needles on the opposite side will be improved so that an improved alignment of the needles will be ensured.

Figure 3:
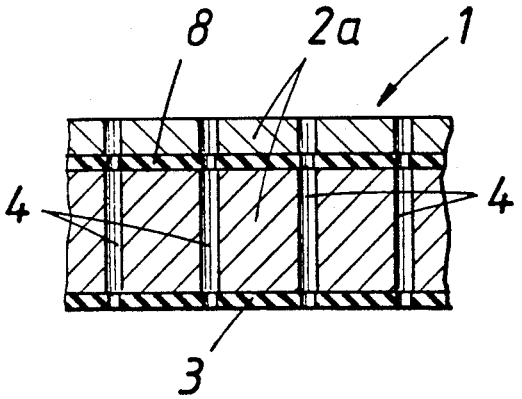
FIGS. 3 and 4 are views which are similar to FIGS. 1 and 2, respectively, and show a modified needle board.
Figure 4:
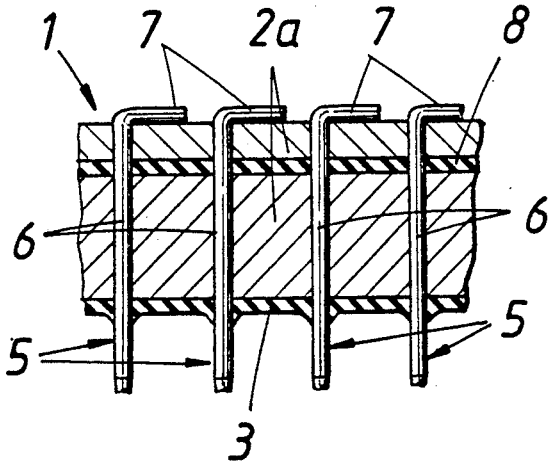

In addition to the elastic layer 3, an elastic interlayer 8 may be provided, which is disposed between that layer 3 and that surface of the plate on which the needle butts 7 are supported, as is shown for an illustrative embodiment in FIGS. 3 and 4. That embodiment is identical in other respects. The interlayer 8 is provided between two elements **2*a* of the carrier plate and through holes 4 are formed in said elements 2*a* and the interlayer 8 by a common drilling operation. The resulting conditions are similar to those in the elastic layer 3 so that the needles are additionally retained. Because the retention of the needles 5 is improved, a looser fit may be provided for the needle shanks 6 in the through holes 4 in the carrier plate 2 or 2*a* so that the risk of stresses arising in the board as the needles are stuck in will greatly be decreased. Besides, any vibration of the needles which may occur when the neddles have become loose will be more effectively damped so that the risk of an expansion of the through holes 4 in the carrier plate 2 or 2*a*** will be reduced and a life can be expected which is longer than that of conventional needle boards. The carrier plate is a rigid carrier plate which has a thickness multiple times the thickness of the elastic layer. The elastic layer performs its retaining of the needles in a non-prestressed state.

We claim:

1. A needle board for an apparatus for needling a non-woven fabric, comprising:

a rigid carrier plate formed with two mutually opposite, parallel broadside surfaces and with a plurality of through holes;

an elastic layer having a thickness which is parallel to said broadside surfaces;

a plurality of needles, which are detachably mounted in said carrier plate and extend through said through holes and said elastic layer are retained thereby;

each of said needles has a shank, guided in one of said through holes, and a butt, angled from said shank, and said butts are supported on one of said rigid broadside surfaces;

said elastic layer is spaced from said one broadside surface and engages said shanks;

said rigid carrier plate having a thickness which is multiple times the thickness of said elastic layer; and said elastic layer performing said retaining of said needles in a non-prestressed state.

2. The needle board set forth in claim 1, wherein said elastic layer is provided on the other of said broadside surfaces.

3. The needle board set forth in claim 2, wherein said carrier plate is provided with an elastic interlayer between said elastic layer and said one broadside surface.

4. The needle board set forth in claim 3, wherein said elastic layer and said elastic interlayer have a Shore hardness below 80.

5. The needle board set forth in claim 1, wherein said elastic layer has a Shore hardness below 80.

* * * * *